US006564385B2

(12) United States Patent
McCarthy

(10) Patent No.: US 6,564,385 B2
(45) Date of Patent: May 20, 2003

(54) HANDLING DEVICE

(76) Inventor: Daniel J. McCarthy, 3643 Southwestern Blvd., Orchard Park, NY (US) 14127

( * ) Notice: Subject to any disclaimer, the term of this patent is extended or adjusted under 35 U.S.C. 154(b) by 0 days.

(21) Appl. No.: 09/904,398

(22) Filed: Jul. 12, 2001

(65) Prior Publication Data

US 2002/0046421 A1 Apr. 25, 2002

Related U.S. Application Data

(60) Provisional application No. 60/217,819, filed on Oct. 6, 2000.

(51) Int. Cl.[7] ..... A41D 13/08
(52) U.S. Cl. ..... 2/16
(58) Field of Search ..... 2/16, 17, 160; 482/44, 48, 100; 294/25, 148, 149; 224/217, 218, 219, 90.12, 901.4

(56) References Cited

U.S. PATENT DOCUMENTS 4,684,559 A * 8/1987 Wasko ..... 428/100
4,793,005 A 12/1988 Hetzel, Jr.
4,809,974 A 3/1989 Buhr
5,004,231 A 4/1991 Alread
5,188,356 A * 2/1993 Furr et al. ..... 273/1.5
5,324,244 A 6/1994 Miller et al.
5,445,383 A * 8/1995 Gleason, Jr. ..... 273/187.2
5,460,308 A * 10/1995 Hahn ..... 224/257
5,557,805 A 9/1996 Emerson
5,651,143 A * 7/1997 Zehrun ..... 2/338
5,722,575 A * 3/1998 Smith ..... 224/917
5,745,920 A 5/1998 Olivier
5,746,685 A * 5/1998 Glaser ..... 482/93
5,813,950 A 9/1998 Parker

* cited by examiner

*Primary Examiner*—John J. Calvert
*Assistant Examiner*—Katherine Moran
(74) *Attorney, Agent, or Firm*—Hodgson Russ LLP

(57) ABSTRACT

The present invention relates to a handling device. The device has an elongated flexible body, a receiving loop, and first and second fastening apparatuses. The elongated flexible body has a first end, a second end, a first terminal end, a top surface, and a bottom surface. The receiving loop is formed at the first end by having the first terminal end securely interconnected to a predetermined position on the elongated flexible body to form an interconnection section on one of the surfaces. The first fastener apparatus is securely attached to the elongated flexible body on one of the surfaces and near the first end. The second fastener apparatus is securely attached to the elongated flexible body on the surface opposite the first fastener apparatus and near the second end, and releasably attaches to the first fastener.

13 Claims, 3 Drawing Sheets

HANDLING DEVICE

CLAIM OF PRIORITY

This application claims priority to U.S. provisional patent application serial No. 60/217,819, filed on Oct. 6, 2000.

FIELD OF THE INVENTION

The present invention relates to a device that assists a person lift objects.

DESCRIPTION OF RELATED ART

In the prior art, straps and other appliances used in facilitating enhanced gripping are known. Applicant is aware of the following United States patents:

U.S. Pat. No. 5,746,685 to Glaser;

U.S. Pat. No. 5,557,805 to Emerson;

U.S. Pat. No. 5,324,244 to Miller et al.;

U.S. Pat. No. 4,793,005 to Hetzel, Jr.;

U.S. Pat. No. 5,004,231 to Alread;

U.S. Pat. No. 5,813,950 to Parker;

U.S. Pat. No. 4,684,559 to Wasko; and

U.S. Pat. No. 4,809,974 to Buhr.

None of these references disclose all of the features and aspects of the present invention.

SUMMARY OF THE INVENTION

The present invention relates to a handling device. The device has an elongated flexible body, a receiving loop, and first and second fastening apparatuses. The elongated flexible body has a first end, a second end, a first terminal end, a top surface, and a bottom surface.

The receiving loop is formed at the first end by having the first terminal end securely attached to a predetermined position on the elongated flexible body to form an interconnection section on one of the surfaces. The first fastener apparatus is securely attached to the elongated flexible body on one of the surfaces and near the first end. The second fastener apparatus is securely attached to the elongated flexible body on the surface opposite the first fastener apparatus and near the second end, and releasably attaches to the first fastener.

DETAILED DESCRIPTION OF THE PREFERRED EMBODIMENTS

Figure 1A:
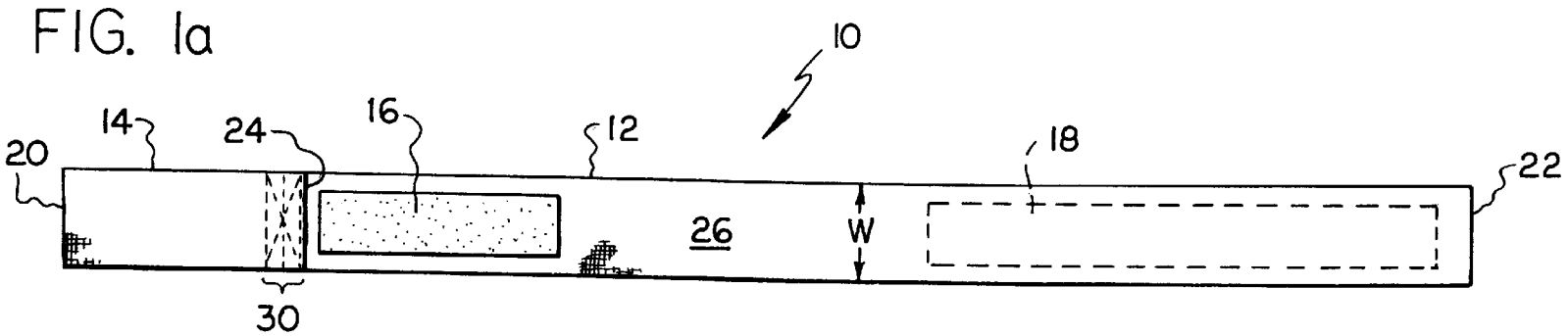
FIG. 1*a* is top view of the present invention.
Figure 1B:
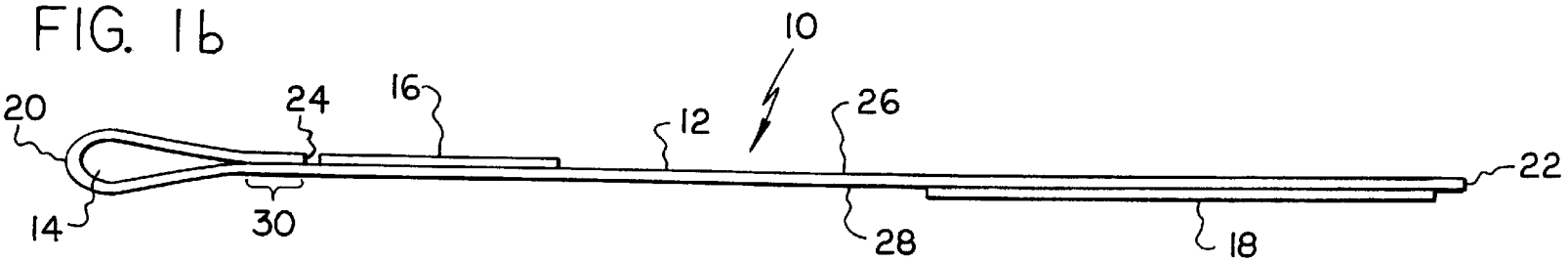
FIG. 1*b* is a side view of FIG. 1*a*.

Referring to FIGS. 1*a* and 1*b*, there is a handling device 10 for use with lifting an object (not shown) in accordance with a preferred embodiment of the present invention. The handling device 10 includes a strap 12 having a receiving loop 14 formed at one end, a first fastening apparatus 16, and a second fastening apparatus 18.

The strap 12 is made of fibrous material. Fibrous materials include, and are not limited to, natural and synthetic materials, like cotton, wool, polymeric resins like polyester, and or mixtures thereof. The strap 12 is an elongated flexible body having a first end 20, a second end 22, a first terminal end 24, a top surface 26, and a bottom surface 28. The strap 12 must have sufficient strength to retain a force equivalent to, or preferably greater than, the force applied to and/or the mass of the lifted object.

Figure 2:
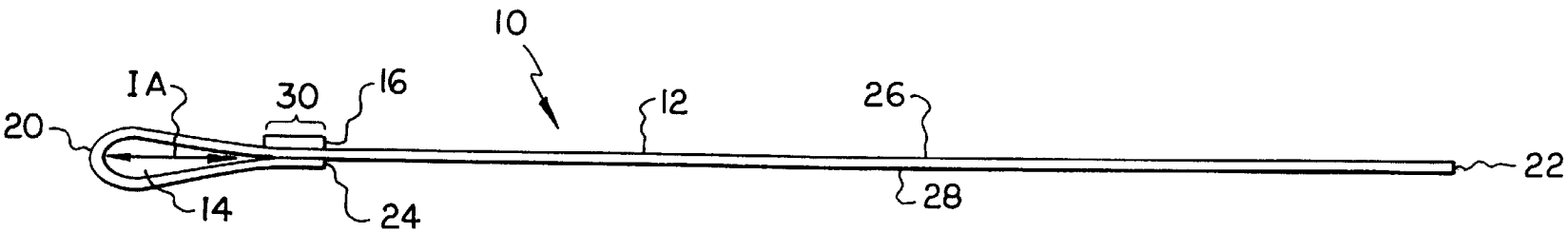
FIG. 2 is an alternative view of Element 16.

The receiving loop 14 is formed at the first end 20 by having the first terminal end 24 securely attached to a predetermined position on the elongated flexible body 12 to form an interconnection section 30 on the top surface 26, as shown in FIGS. 1*a* and 1*b*, or on the bottom surface 28 as shown in FIG. 2. The secure interconnection is obtained by conventional methods, one of which is stitching. The predetermined position can be located anywhere along the elongated flexible body 12. Preferably, the predetermined position is between the first terminal end and the half-way point of the elongated flexible body 12.

Figure 3:
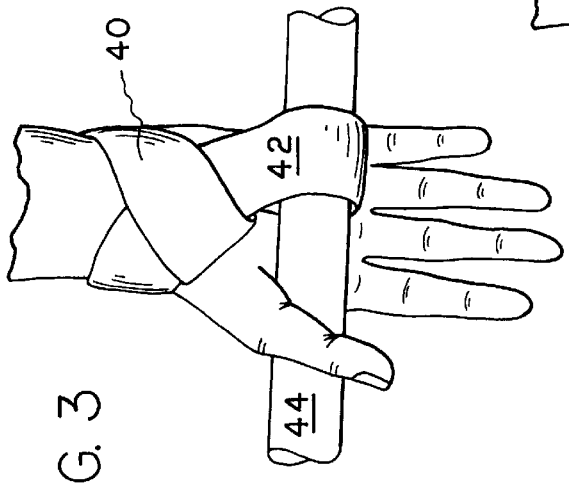
FIG. 3 is an illustration of the present invention being used.

Wherever the interconnection section 30 occurs, the resulting receiver loop 14 has to have an inner aperture IA 32 equal to or greater than the width W of the elongated flexible body 12. The inner aperture IA must have such a size in order for the second end 22 to slip into the inner aperture IA to form a wrist loop 40, as shown in FIG. 3, without any buckling by the body 12.

The wrist loop 40 is adjustable to fit over a user's hand and secure to the user's wrist. The remaining elongated flexible body 42 extends from the wrist loop 42 to wrap around the object 44 to be lifted and have the second fastening apparatus 18 releasably interconnect with the first fastening apparatus 16.

The first fastening apparatus 16 and the second fastening apparatus 18 are designed to releasably interconnect with each other. An example of such a design is a conventional hook and loop system. To make the device 10 connect without excessive twisting the first and second fastening apparatuses 16, 18 are on opposite surfaces, top surface 26 and bottom surface 28.

Figure 4:
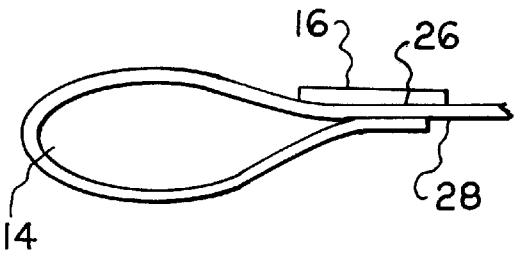
FIGS. 4–7 are alternative embodiments of Element 16.

The first fastener apparatus 16 is securely attached to the elongated flexible body 12 on one of the surfaces, on the top surface as shown in FIGS. 1*a* and 1*b* and 2, and on the bottom surface as shown in FIG. 4. Moreover, the first apparatus 16 is near the first end. In particular, the first apparatus can be located in at least five locations.

Figure 5:
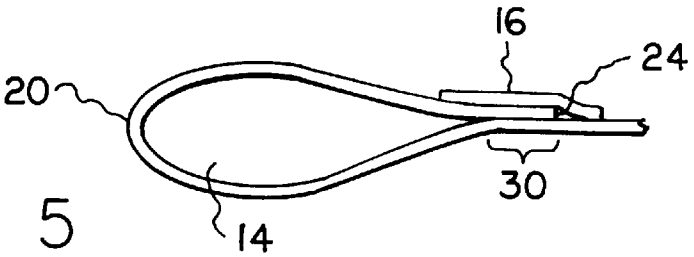

The first and second locations are used when the interconnection section 30 is on one surface 26/28 and the first apparatus is on at least the same surface. The first location is when the first apparatus is adjacent to the interconnection section, as shown in FIG. 1*a*. The second location is when a portion of the first apparatus overlies at least a portion of the interconnection section 30 and a predetermined portion of the same surface, as shown in FIG. 5.

Figure 6:
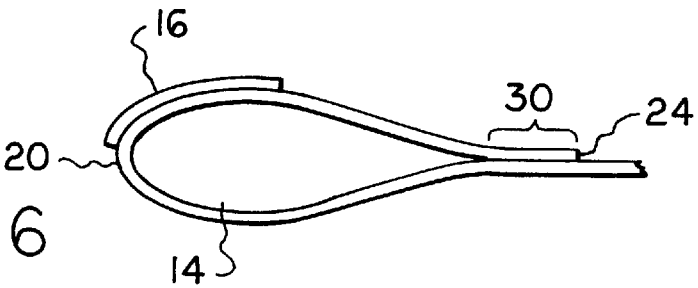
Figure 7:
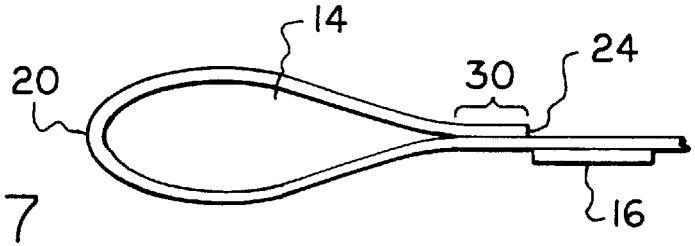

The third, fourth, and fifth locations are used when the interconnection section 30 is on one surface 26/28 and the first apparatus 16 is on the opposite surface. The third location is when the first apparatus 16 is positioned entirely on the receiving loop 14, as shown in FIG. 6. The fourth location is when at least a portion of the first apparatus 16 is positioned immediately over the interconnection section 30, as shown in FIG. 2. And the fifth location is when the first apparatus 16 is adjacent to the interconnection section 30 and not on the receiving loop 14, as shown in FIG. 7.

In contrast, the second fastening apparatus 18 is positioned on the opposite side of the first fastening apparatus 16, and positioned near the second end 22.

The present invention assists the user lift an object. The object can be any shape or design. For example, the object can be a pail, a rod, a weightlifting bar, a bag with a handle, a baseball bat, a racket for a sporting event, and a gardening tool. In any event, the device 10 has some advantages over the prior devices.

Figure 8:
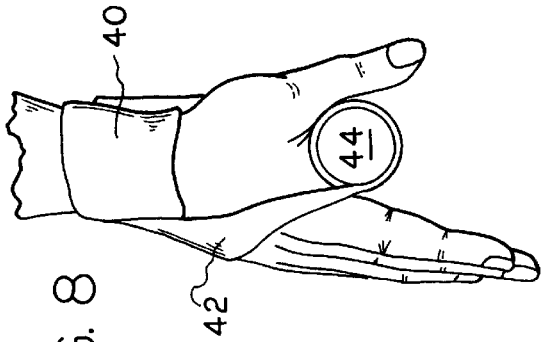
FIGS. 8–11 are an alternative embodiment of FIG. 3.

The device 10 enables a user to maintain a firm hold on a bar, as illustrated in FIG. 3, even if the user's fingers or grip is weak. As shown in FIG. 8, the wrapping of the remainder of the elongated flexible body 42 can be loosely slung about the object, or the wrapping of body 42 can be securely fitted in the user's palm as illustrated in FIG. 3. In either embodiment, the workload on the user's fingers and hand will be reduced.

It is also known that when a user performs various lifts, the user's fingers give out long before the larger muscles are effectively worked. The device 10 allows a lifter to maintain a grip long enough to exhaust, and train, the larger muscles.

Figure 9:
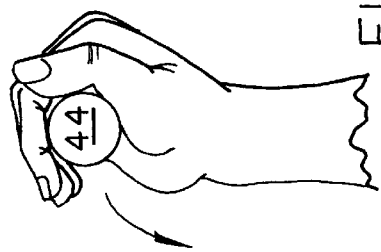

Many power lifters benchpress with their thumb on the backside of a weightlifting bar. That position promotes safety and sacrifices a more favorable and stronger wrist position. Strapping the device to a weightlifting bar will help prevent the bar from slipping out and falling on the user, as shown in FIG. 9.

Figure 10:
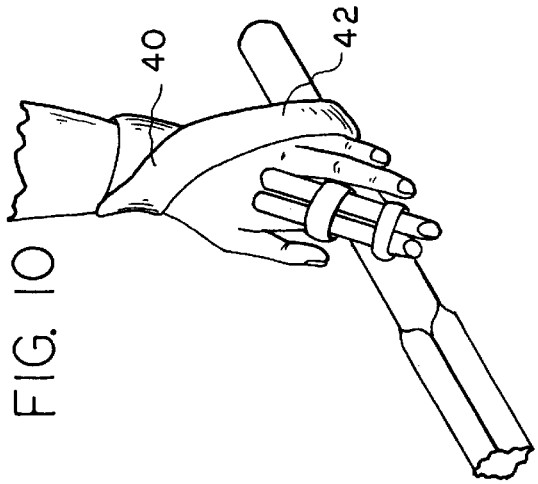

The device 10 can also assist user's having an injured or arthritic hand. For example, a wheelbarrow is lifted through a user's palm and fingers. The device 10 when applied to the wheelbarrow can assist the user by easing the load on the user's fingers as shown in FIG. 10, to the wrist.

Figure 11:
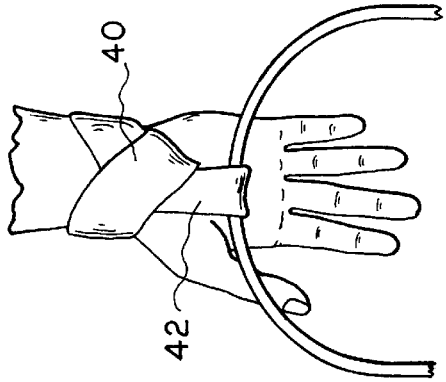

The device 10 also can decrease the chance that a narrow handle, like a pail's wicket, can damage the user's hand. The device 10 can thicken the handle and allow the user to carry the pail by fingers and/or the wrist, as shown in FIG. 11.

Although variations in the embodiment of the present invention may not each realize all the advantages of the invention, certain features may become more important than others in various applications of the device. The invention, accordingly, should be understood to be limited only by the scope of the appended claims.

I claim:

1. A device comprising:

an elongated flexible body having a first end, a second end, a first terminal end, a top surface, and a bottom surface;

a receiving loop formed at the first end by having the first terminal end securely interconnected to a predetermined position on the elongated flexible body to form an interconnection section on the top surface;

a first fastener apparatus securely attached to the elongated flexible body on the bottom surface and near the first end;

a second fastener apparatus securely attached to the elongated flexible body on the top surface and near the second end, and releasably attachable to the first fastener;

wherein the receiving loop has an inner aperture that can receive the second end to form a wrist loop;

the wrist loop has an inner diameter that can receive a user's hand and securely wrap to the user's wrist;

the elongated flexible body has a width and length that allows the elongated body to be wrapped about a liftable object, the second fastener apparatus releaseably attached to the first fastener apparatus so the liftable object can be lifted without using the user's fingers;

wherein the first fastener apparatus is between the interconnection section and the half-way point of the elongated flexible member.

2. The device of claim 1 wherein the first and second fastener apparatuses are a hook and loop system.

3. The device of claim 1 wherein the elongated flexible body is made of a material selected from a group consisting of a natural fibrous material, and a synthetic fibrous material.

4. The device of claim 1 wherein the predetermined position does not extend beyond the half-way point of the elongated flexible body.

5. The device of claim 1 wherein the interconnection section overlies a portion of the first fastener apparatus.

6. The device of claim 1 wherein the first fastener apparatus is entirely on the receiving loop.

7. A method of lifting an object comprising:

obtaining a device having an elongated flexible body having a first end, a second end, a first terminal end, a top surface, and a bottom surface; a receiving loop formed at the first end by having the first terminal end securely interconnected to a predetermined position on the elongated flexible body to form an interconnection section on the top surface; a first fastener apparatus securely attached to the elongated flexible body on the bottom surface and near the first end; a second fastener apparatus securely attached to the elongated flexible body on the top surface and near the second end, and releasably attachable to the first fastener; wherein (a) the receiving loop has an inner aperture that can receive the second end to form a wrist loop, (b) the wrist loop has an inner diameter that can receive a user's hand and securely wrap to the user's wrist, (c) the elongated flexible body has a width and length that allows the elongated body to be wrapped about a liftable object, the second fastener apparatus releaseably attached to the first fastener apparatus so the liftable object can be lifted without using the user's fingers; and (d) the first fastener apparatus is between the interconnection section and the half-way point of the elongated flexible member;

inserting the second end into the receiving loop which has an inner aperture that can receive the second end, to form a wrist loop;

securing the wrist loop to a user's wrist;

wrapping the elongated flexible body about the liftable object;

releaseably attaching the second fastener apparatus to the first fastener apparatus so the liftable object can be lifted without using the user's fingers.

8. The method of claim 7 wherein the first and second fastener apparatuses are a hook and loop system.

9. The method of claim 7 wherein the liftable object is selected from the group consisting of a pail, a rod, a weightlifting bar, a bag with a handle, a baseball bat, a racket for a sporting event, and a gardening tool.

10. The method of claim 7 wherein the elongated flexible body is made of a material selected from a group consisting of a natural fibrous material, and a synthetic fibrous material.

11. The method of claim 7 wherein the predetermined position does not extend beyond the half-way point of the elongated flexible body.

12. The method of claim 7 wherein the first fastener apparatus is on the bottom surface and is located on the bottom surface at a position selected from the group consisting of the interconnection section overlying a portion of the first fastener apparatus, entirely on the receiving loop, and between the interconnection section and the half-way point of the elongated flexible member.

13. The method of claim 7 wherein the first fastener apparatus is on the top surface.

* * * * *